United States Patent [19]

Rockhill

[11] Patent Number: 4,887,543

[45] Date of Patent: Dec. 19, 1989

[54] UNFORGETTABLE UMBRELLA METHOD

[76] Inventor: Sondra Rockhill, 15 Bunting Ave., Burlington, N.J. 08016

[21] Appl. No.: 321,208

[22] Filed: Mar. 9, 1989

[51] Int. Cl.[4] ..... A45B 25/30

[52] U.S. Cl. ..... 116/201; 116/307; 135/16

[58] Field of Search ..... 40/6, 317, 330, 634; 116/201, 306, 307; 135/16, 20 R, 65 R, DIG. 11; D3/5-10, 12, 13

[56] References Cited

U.S. PATENT DOCUMENTS

| | | | |
|---|---|---|---|
| D. 287,665 | 1/1987 | Cain | D3/12 |
| 1,369,846 | 3/1921 | Scutt | 40/317 |
| 2,128,634 | 8/1938 | Capaldo | 135/20 R |
| 2,493,705 | 1/1950 | Vogel | D3/5 |
| 2,759,486 | 8/1956 | Pesaturo | 135/46 |
| 2,838,058 | 6/1958 | Foltis et al. | 135/48 |
| 4,236,479 | 12/1980 | Walker et al. | 116/28 R |
| 4,257,342 | 3/1981 | Ditto | 116/307 |
| 4,521,981 | 6/1985 | Kasprzycki | 40/330 |
| 4,542,757 | 9/1985 | Phillips | 135/16 |
| 4,586,524 | 5/1986 | Smith | 135/16 |
| 4,592,157 | 6/1986 | Kerr | 40/634 |

FOREIGN PATENT DOCUMENTS

| | | | |
|---|---|---|---|
| 1497493 | 9/1967 | France | 40/634 |
| 548016 | 1/1977 | Switzerland | 135/20 R |
| 481581 | 6/1936 | United Kingdom | 135/20 R |

*Primary Examiner*—Allan N. Shoap
*Assistant Examiner*—W. Morris Worth
*Attorney, Agent, or Firm*—Thomas A. Lennox

[57] ABSTRACT

A method and a device to aid in recollecting to retrieve an umbrella left in a building including an eye device on the handle of the umbrella with a identification plastic panel attached with a spring clip through the eye. The identification device is unclipped from the umbrella when the umbrella is left behind upon entrance to the building and is immediately clipped onto a key ring on which automobile or residence door keys are clipped. If the umbrella is forgotten, the next use of the key ring will automatically remind the user that the umbrella has been left behind. After the umbrella has been retrieved, the identification device is unclipped from the key ring and reattached to the eye device on the umbrella for the next use.

14 Claims, 1 Drawing Sheet

UNFORGETTABLE UMBRELLA METHOD

BACKGROUND OF THE INVENTION

This invention involves a method to avoid forgetting an umbrella when leaving an establishment.

Most all persons have forgotten and ultimately lost a number of umbrellas during their lifetime. It is a common problem but no satisfactory solution has been provided. Persons have become so accustomed to losing umbrellas, that it is accepted that umbrellas will be regularly forgotten and lost. Unfortunately this attitude has adversely affected the quality of umbrellas and the market for high quality umbrellas. In particular marketing high fashion umbrellas is deterred because the purchasing public does not consider them "permanent" property. At one time, ladies parasols and fine mens' umbrellas and canes were included in high fashion statements. Recently, the umbrella and cane have been relegated to mere practical designs without including them in the fashion of the day.

Of course, the term "umbrella", is intended to include parasols, canes and like products. Although the typical place of losing umbrellas is in a restaurant or store, it should be recognized that they are also lost at person's homes when a gathering of persons makes it difficult for the host to remember whose umbrella has been left behind. A method to aid in remembering to pick up the umbrellas must be effective regardless of where the umbrellas is left. The terms "restaurant" or "store" used throughout the specification are intended to include any place that an umbrella may be left when entering a building.

None of the prior art devices or methods had satisfied this need nor attained the objects described hereinbelow.

SUMMARY OF THE INVENTION

It is an object of this invention to provide a method and a device which essentially makes it impossible to forget the umbrella or like item upon leaving a place where the umbrella was temporarily placed.

It is a further object of the present invention to provide a method and a device to aid the memory by involving the use of an item that must of necessity be used soonafter the umbrella was inadvertently left behind.

An object of this invention is to provided an aid in remembering to pick up the umbrella by providing a reminder that the umbrella was previously left behind under such circumstances and after such a short period of time that the person is most likely to remember the location of the umbrella and be in a position to return to the location and retrieve it.

It is a specific object of the present invention to utilize the common key ring, which is used essentially by all persons to hold the keys to their residences, and in many cases to their automobiles, to aid in the remembering process and method of this invention to recall the necessity of retrieving an umbrella.

It is a particular object of the present invention to provide a method to aid the memory in remembering to pick up an umbrella and in the process provide an identification system to identify the particular umbrella being retrieved.

The invention is a method to aid the memory in remembering to pick up an umbrella from a location upon leaving a building where the umbrella was placed upon entrance to the building. The method further includes providing an eye means with an opening to receive a clip, on a handle of the umbrella. The method further includes providing a member having a perceptible surface with a clip means to detachably attach onto the eye means. The method also includes providing identification means on the umbrella and on the surface of the member to visually indicate that the umbrella and the member go together. The method further includes attaching the member to the eye means on the umbrella. The method also includes removing the member by detaching it from the umbrella upon entering a building. The method further includes placing the umbrella at the location wherein the umbrella is to be temporarily left in the building. The method also includes attaching the member to a key ring on which automobile or residence doors keys presently in use are attached. The member is of sufficient size and shape that it will be readily noticeable when the keys are next used.

It is preferred that the method lastly include removing the member from the key ring upon retrieving the umbrella, and reattaching the member to the eye means of the umbrella. It is preferred that the eye means include an integral molded eye shape extending from a side of the handle of the umbrella. It is further preferred that the member be a molded polymeric plastic panel tag with a spring clip attached thereto. It is also preferred that the identification means is a design on the surface of the member and an essentially identical design, except for size, on fabric of the umbrella, It is further preferred that the design include a flower design. It is also preferred that the clip means includes a spring clip and attaching the member is by clipping the member to the umbrella or to the key ring.

The invention is also a device to aid the memory in remembering to pick up an umbrella upon leaving a building from a location where the umbrella was placed upon entrance to the building. The device includes an eye means with an opening to receive a clip means, on a handle of the umbrella. The device also includes a member having a perceptible surface with a clip means to detachably attached onto the eye means and onto a key ring on which automobile or residence door keys presently in use are attached. The device also includes identification means on the umbrella and on the surface of the member to visually indicate that umbrella and the member go together. The member is of sufficient size and shape that it will be readily noticeable when the keys are next used.

DESCRIPTION OF PREFERRED EMBODIMENTS

Figure 1:
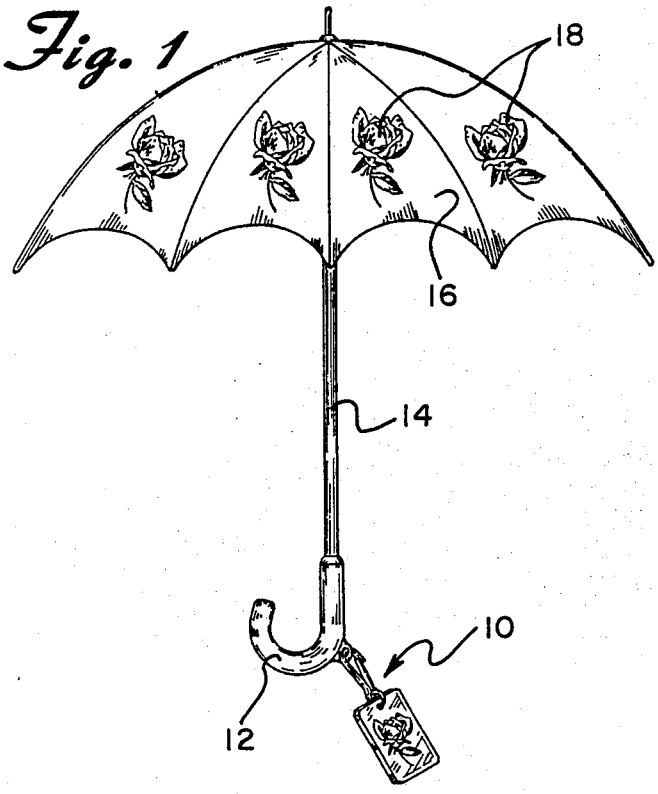
FIG. 1 is a perspective view of an umbrella to which is attached an identification member that is part of the device and method of the present invention.

In FIG. 1, identification and reminder device 10 is clipped to handle 12 at the end of body 14 which supports fabric cover 16 of the umbrella. The identification pattern 18 is imprinted upon the fabric and in this case is a rose decoration. The identification means may be any design drawing, lettering or pattern or uncolored. It may be initials or a readily identifiable flower pattern. The identification pattern may be customized to the particular owner of the umbrella.

Figure 2:
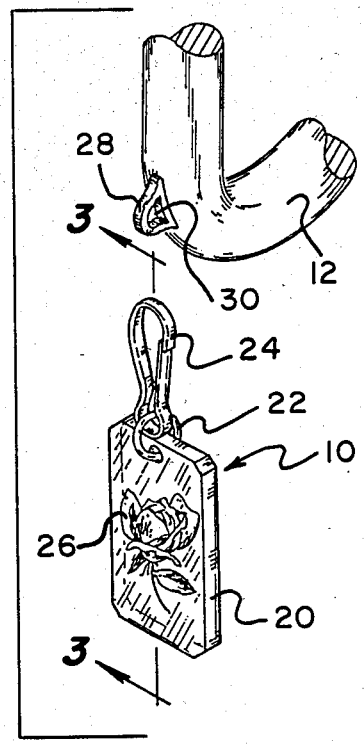
FIG. 2 is an enlarged cut-away view of a portion of the handle of the umbrella illustrated in FIG. 1 with the identification member exploded away.
Figure 3:
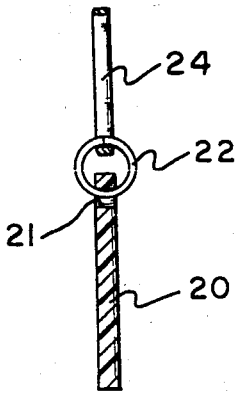
FIG. 3 is a cross-sectional view taken along lines 3—3 of FIG. 2.
Figure 4:
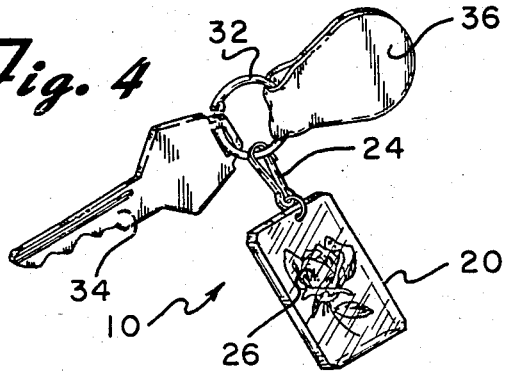
FIG. 4 is a perspective view of a key ring to which the identification member has been clipped as part of the method and use of the device of the present invention.

In FIG. 2, identification device 10 is shown including panel member 20 which in this case is a ⅛ inch thick transparent sheet of polymethyl methacrylate, polished on all edges to be an attractive member. Solid ring 22 is threaded through a hole in panel 20 and spring clip 24 is engaged on ring 22. Rose pattern 26 is on a surface of panel 20 wherein that surface has a dimension of about 1½ by 3 inches. This size is sufficient to be readily perceived and noticeable when it is clipped onto eye shape 28 which is part of the integral molding of umbrella handle 12 providing opening 30 in the eye shape through which spring clip 24 is engaged. Identification pattern 26 is essentially identical to pattern 18 on the fabric. It is of a reduced size, but its color and design is essentially identical except for the size. Panel 20 may be constructed of a variety of satisfactory materials so long as it provides a perceptible surface on which the identification design is easily visible. Panel 20 may be constructed of a metal sheet polished and plated to have a pleasing appearance. The identification design may be painted or applied with a decal. The panel may also be other polymeric plastic materials such a polystyrene, polycarbonate, nylon and other engineering plastics. FIG. 3 shows solid ring 22 threaded through hole 21 of panel 20 with spring clip 24 attached to the ring. In FIG. 4, identification device 10 is attached to key ring 32 through spring clip 24 upon which key 34 is also engaged. Although this diagram does not illustrate the relative size, panel 20 is chosen of a size and shape such that it approaches or exceeds the shape of attachment 36 on key ring 32 such that the presence of panel 20 would be readily noticeable when key 34 was next used.

While this invention has been described with reference to the specific embodiments disclosed herein, it is not confined to the details set forth and the patent is intended to include modifications and changes which may come within and extend from the following claims.

I claim:

1. A method to aid the memory in remembering to retrieve an umbrella upon leaving a building from a location where the umbrella was placed upon entrance to the building, the method comprising:

(a) providing an eye means with an opening to receive a clip means, on a handle of the umbrella, (b) providing a member having a perceptible surface with a clip means to detachably attach onto the eye means, (c) providing identification means on the umbrella and on the member to visually indicate that umbrella and the member go together, (d) attaching the member to the eye means on the umbrella, (e) removing the member by detaching it from the umbrella upon entering a building, (f) placing the umbrella at the location where the umbrella is to be temporarily left in the building, and (g) attaching the member to a key ring on which automobile or residence door keys presently in use are attached, wherein the member is of sufficient size and shape that it will be readily noticeable when the keys are next used.

2. The method of claim 1 further comprising:

(a) removing the member from the key ring upon retrieving the umbrella, and (b) reattaching the member to the eye means of the umbrella.

3. The method of claim 1 wherein the eye means comprises an integral molded eye shape extending from a side of the handle of the umbrella.

4. The method of claim 1 wherein the member is a molded polymeric plastic panel tag with a spring clip attached thereto.

5. The method of claim 1 wherein the identification means is a design on a surface of the member and an essentially identical design, except for size, on fabric of the umbrella.

6. The method of claim 5 wherein the design comprises a flower design.

7. The method of claim 1 wherein the clip means comprises a spring clip and attaching the member is by clipping the member to the umbrella or to the key ring.

8. A method to aid the memory in remembering to retrieve an umbrella upon leaving a building from a location where the umbrella was placed upon entrance to the building, the method comprising:

(a) providing an eye means with an opening to receive a clip means, on a handle of the umbrella, (b) providing a member having a perceptible surface with a clip means to detachably attach onto the eye means, (c) providing identification means on the umbrella and on the surface of the member to visually indicate that umbrella and the member go together.

(d) attaching the member to the eye means on the umbrella, (e) removing the member by detaching it from the umbrella upon entering a building, (f) placing the umbrella at the location where the umbrella is to be temporarily left in the building, (g) attaching the member to a key ring on which automobile or residence door keys presently in use are attached, wherein the member is of sufficient size and shape that is will be readily noticeable when the keys are next used, (h) removing the member from the key ring upon retrieving the umbrella, and (i) reattaching the member to the eye means of the umbrella wherein the eye means comprises an integral molded eye shape extending from a side of the handle of the umbrella.

9. The method of claim 8 wherein the member is a molded polymeric plastic panel tag with a spring clip attached thereto.

10. The method of claim 8 wherein the identification means is a design on the surface of the member and an essentially identical design, except for size, on fabric of the umbrella.

11. The method of claim 10 wherein the design comprises a flower design.

12. The method of claim 8 wherein the clip means comprises spring clip and attaching the member is by clipping the member to the umbrella or to the key ring.

13. A method to aid the memory in remembering to retrieve an umbrella upon leaving a building from a location where the umbrella was placed upon entrance to the building, the method comprising:

(a) providing an eye means with an opening to receive a spring clip, comprising an integral molded eye shape extending from a side of the handle of the umbrella, (b) providing a molded polymeric plastic panel tag having a perceptible surface with a spring clip attached to the tag to detachably clip onto the eye means, (c) providing identification means comprising a design on the surface of the tag and an essentially identical design, except for size, on fabric of the umbrella to visually indicate that umbrella and the tag go together.

(d) clipping the tag to the eye means on the umbrella, (e) removing the tag by unclipping it from the umbrella upon entering a restaurant or store where the umbrella is to be left, (f) placing the umbrella at the location where the umbrella is to be temporarily left in the building, (g) clipping the member to a key ring on which automobile or house door keys are attached, wherein the tag is of sufficient size and shape that it will be readily noticeable when the keys are next used, (h) removing the member from the key ring upon retrieving the umbrella; and (i) reattaching the member to the eye means of the umbrella.

14. The method of claim 13 wherein the design comprises a flower design.

* * * * *